US007896474B2

(12) United States Patent
Kasai et al.

(10) Patent No.: US 7,896,474 B2
(45) Date of Patent: Mar. 1, 2011

(54) LIQUID EJECTION HEAD AND RECORDING APPARATUS

(75) Inventors: Ryo Kasai, Tokyo (JP); Mineo Kaneko, Tokyo (JP); Masataka Sakurai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 325 days.

(21) Appl. No.: 12/196,804

(22) Filed: Aug. 22, 2008

(65) Prior Publication Data

US 2009/0058948 A1 Mar. 5, 2009

(30) Foreign Application Priority Data

Aug. 28, 2007 (JP) ..... 2007-221219

(51) Int. Cl.
*B41J 2/05* (2006.01)

(52) U.S. Cl. ..... 347/56; 347/65

(58) Field of Classification Search ..... 347/56, 347/61–65, 50, 54, 57–59, 40, 42, 44, 47, 347/20

See application file for complete search history.

(56) References Cited

U.S. PATENT DOCUMENTS 4,458,256 A 7/1984 Shirato et al.
5,164,747 A 11/1992 Osada et al.
5,682,190 A 10/1997 Hirosawa et al.
6,139,761 A 10/2000 Ohkuma et al.
6,412,920 B1 7/2002 Matsumoto et al.
6,561,632 B2 * 5/2003 Feinn et al. ..... 347/65
6,652,079 B2 * 11/2003 Tsuchii et al. ..... 347/65
7,354,125 B2 4/2008 Hirayama et al.
7,641,317 B2 * 1/2010 Matsui et al. ..... 347/65
7,690,768 B2 * 4/2010 Eguchi et al. ..... 347/56
2007/0165055 A1 7/2007 Hirayama et al.
2008/0001994 A1 1/2008 Kaneko

* cited by examiner

*Primary Examiner*—K. Feggins
(74) *Attorney, Agent, or Firm*—Fitzpatrick, Cella, Harper & Scinto

(57) ABSTRACT

A liquid ejection head includes a plurality of ejection outlets for ejecting a liquid droplet; a plurality of flow paths communicating with the ejection outlets; an ink supply port for supplying liquid to the flow paths; and a plurality of heat generating elements provided correspondingly to the ejection outlets, for generating thermal energy for ejecting liquid present inside the flow paths. The plurality of heat generating elements is arranged in a staggered fashion with predetermined intervals with respect to a direction of a long side of the ink supply port. Adjacent staggered heat generating elements are connected to a common wiring line and are connected to individual wiring lines.

7 Claims, 7 Drawing Sheets

(A-A)

(B-B)

LIQUID EJECTION HEAD AND RECORDING APPARATUS

FIELD OF THE INVENTION AND RELATED ART

The present invention relates to a liquid Ejection head provided with wiring lines for Electrically connecting heat generating elements and a Recording apparatus including the liquid ejection head.

A recording apparatus is constituted so that Information is recorded on a recording material such as a recording sheet, by ejecting recording ink from a Plurality of minute ejection outlets of a liquid Ejection head depending on a recording signal. Such a Recording apparatus has advantages such as non-contact Recording on the recording material, easy colorization, less-noisiness, etc.

As an example of a liquid ejection method, an ink jet method for ejecting ink by utilizing thermal energy will be described. A liquid ejection head used in the ink jet method is provided with recording Elements (e.g., heat generating elements or heaters) corresponding to ejection outlets for ejecting liquid such as ink. The liquid ejection head ejects ink droplets by generating heat under application of a current to the heater to cause bubble generation of the ink, thus effecting recording.

The liquid ejection head is required to dispose heaters on a liquid ejection substrate of silicon or the like (hereinafter referred to as a "device substrate") with a high density in order to obtain a high-definition recording image. In such a liquid ejection head using the liquid ejection method, a constitution in which a plurality of square or rectangular heat generating elements (hereinafter referred to as "heaters") is arranged in a line on the device substrate and thereafter wiring lines are connected and flow paths are formed has been known. A recording head having such a constitution, compared with those of other types, has advantages such that ink ejection outlets are arranged with a high density and that a high-speed and high-definition image can be obtained.

Such a liquid ejection head is disclosed in U.S. Pat. No. 6,139,761 and schematic views thereof are shown in FIGS. 6A and 6B. As shown in FIGS. 6A and 6B, the liquid ejection head includes an ink supply port 601 formed in a silicon substrate through anisotropic etching. Further, partition walls 603 for ink flow paths 604 and ink ejection outlets 602 are formed by a known production method such as an exposure technology or etching. Heaters 607 are provided correspondingly to the ink ejection outlets 602 one by one. The ink ejection outlets 602 and the heaters 607 which oppose those through the ink supply port 601 are arranged with a pitch shifted by ½ of The pitch from the opposite ink ejection outlets 602 and heaters 607 with respect to an arrangement direction (a long side direction of the ink supply port 601). The ink ejection outlets 602 and the heaters 607 for each ink supply port 601 are arranged with a high density along the long side direction of the ink supply port 601.

In order to carry out recording with higher definition and higher speed by the above-described production process and constitution, the density of the ink ejection outlets is increased by various methods or means. However, various problems arise with the increase in density of the ink ejection outlets.

First, there is a problem with respect to a heater size. FIG. 7 shows a layout of a conventional heater and a periphery of the heater. As shown in FIG. 7, at a position opposite from an ink ejection outlet 704, a heater 703 is provided. An ink flow path 705 for connecting the ink ejection outlet 704 and an ink supply port 707 is formed by a partition wall 708. A plurality of heaters 703 is arranged with a certain interval of a density of 600 dpi, i.e., with a pitch of about 42 μm. To each of the heaters 703, an individual power wiring line (individual electrode) 701 to be electrically connected to a VH power source for supplying electric power to the heater 703 and an individual driver wiring line (individual electrode) 702 to be electrically connected to a driver for controlling a heating time of the heater 703 is provided.

In the case where an ink droplet with an ejection amount 5 pl is ejected by the heater 703, assuming that a sheet resistance of the heater 703 is 350 Ω/□, it is necessary to use a heater having a size of about 20 μm×20 μm. In the case of this constitution, a pitch of the heaters 703 with respect to an arrangement direction is about 42 μm, so that a space between adjacent heaters 703 with respect to the arrangement direction has a margin of about 20 μm. For this reason, in the case of the constitution, it is possible to comfortably form the partition wall 708 constituting the ink flow path 705 and the individual power source wiring line (Al wiring line) 701 as an individual VH electrode.

However, in the case where the heaters 703 having the above-described size are arranged with an interval of a density of 1200 dpi (a pitch of about 21 μm) which is two times that in the above-described constitution, a spacing between adjacent heaters 703 is substantially "0 (zero)", so that it is difficult to form the partition wall between the adjacent heaters 703. Further, also with respect to the individual power source wiring line 701, similarly, the space for arrangement thereof between the adjacent heaters 703 cannot be ensured, so that it is difficult to realize the arrangement with the density of 1200 dpi by using the heaters having the size in this case.

For that reason, in order to realize the arrangement with the heater density of 1200 dpi, it is necessary to decrease a heater size. In the case where the heater size is decreased, thermal energy for heating the ink is also decreased, so that it is necessary to decrease the size of the ink droplet.

For example, in the case where an ejection amount of the ink droplet is decreased down to 0.5 p1, it is possible to decrease the heater size down to about 15 μm×15 μm (when the same material as that of the above-described heater is used). In this case, the spacing between adjacent heaters is about 6 μm, so that it is possible to form the partition wall. However, a thickness of such a partition wall fails to ensure a mechanical strength resistant to bubble generation of the ink.

Further, in the spacing of about 6 μm, only the individual power source wiring line having a very small width can be formed, so that a wiring resistance is high, thus resulting in liability to heat generation and power loss.

It is also possible to employ a method in which the shape of the heater is made rectangular thereby to decrease a width of the heater to increase a space between adjacent heaters. However, the rectangular heater is liable to be subjected to constraints of dimension design and design of a driving circuit or a heater resistance. In addition, the rectangular heater, compared with a square heater, involves a problem that it is largely affected by a change in ejection direction by ink ejection outlets, so that it is desirable that the shape of the heater is square.

As another constitution for realizing the arrangement with the heater density of 1200 dpi, a constitution in which wiring lines are disposed immediately under heaters is disclosed in U.S. Pat. No. 4,458,256. FIG. 8 shows a layout of the wiring lines. As shown in FIG. 8, at a position opposite from an ink ejection outlet 804, a heater 803 is provided. An ink flow path 805 for communicating the ink ejection outlet 804 and an ink supply port 807 with each other is formed by a partition wall 808. Further, each wiring line as an electrode connected to each heater 803 is formed in two layers consisting of an individual power source wiring line 801 as an upper layer and an individual driver wiring line 802 as a lower layer. These upper and lower layers, i.e., the individual power source wiring line 801 and the individual driver wiring line 802 establish electrical conduction through a through hole 806.

However, in the case of such a layout of the wiring lines, the individual driver wiring line 802 as the lower layer is formed below the heater 803, so that heat generated by the heater 803 adversely affects an Al wiring line constituting the individual driver wiring line 802. In this case, e.g., a minute projection called a hillock is liable to occur at the surface of a wiring line film of the individual driver wiring line 802, so that short circuit failure can occur between the individual power source wiring line 801 and the individual driver wiring line 802 which constitute the upper and lower (two) layers. Further, in the case where the Al wiring line constituting the individual driver wiring line 802 as the lower layer causes thermal deformation, flatness of the heater 803 is deteriorated by the thermal deformation of the lower layer, so that an ink ejection characteristic can also be adversely affected by the thermal deformation.

SUMMARY OF THE INVENTION

A principal object of the present invention is to provide a liquid ejection head capable of sufficiently ensuring a thickness of a partition wall between adjacent heat generating elements arranged in a staggered fashion and realizing a wiring structure with relatively low power loss and temperature rise to result in arrangement of ejection outlets with a high density.

Another object of the present invention is to provide a recording apparatus including the liquid ejection head.

According to an aspect of the present invention, there is provided a liquid ejection head comprising:

a plurality of ejection outlets for ejecting a liquid droplet;

a plurality of flow paths communicating with the ejection outlets;

an ink supply port for supplying liquid to the flow paths; and a plurality of heat generating elements provided correspondingly to the ejection outlets, for generating thermal energy for ejecting liquid present inside the flow paths, wherein the plurality of heat generating elements is arranged in a staggered fashion with predetermined intervals with respect to a direction of a long side of the ink supply port, and wherein adjacent staggered ones of the heat generating elements are connected to a common wiring line and are connected to individual wiring lines.

According to the present invention, the common wiring line is provided, so that a thickness of the partition wall between the adjacent staggered ones of the heat generating elements is sufficiently ensured and a wiring structure with relatively low power loss and temperature rise. As a result, it is possible to increase in density of arrangement of the ejection outlets.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, embodiments of the present invention will be described with reference to the drawings.

<Recording Apparatus>

Figure 5:
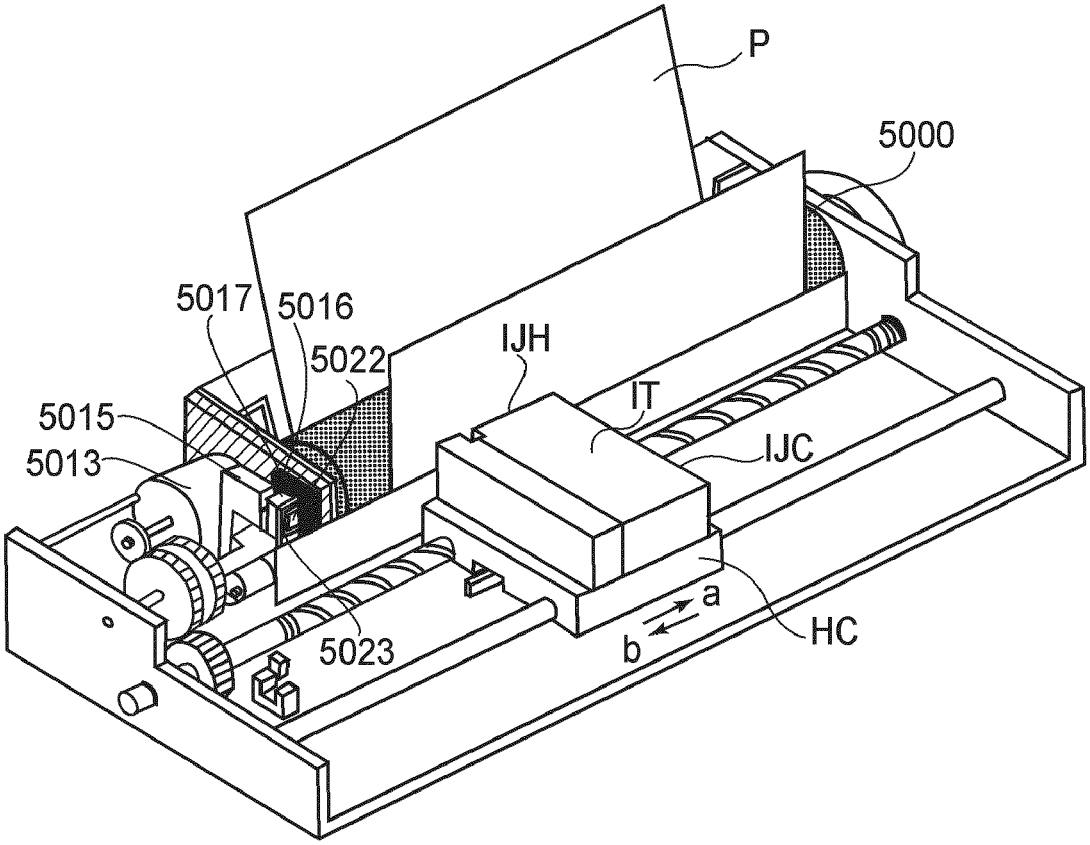
FIG. 5 is a schematic perspective view showing a principal portion of a recording apparatus applicable to an embodiment of the present invention.
Figure 6A:
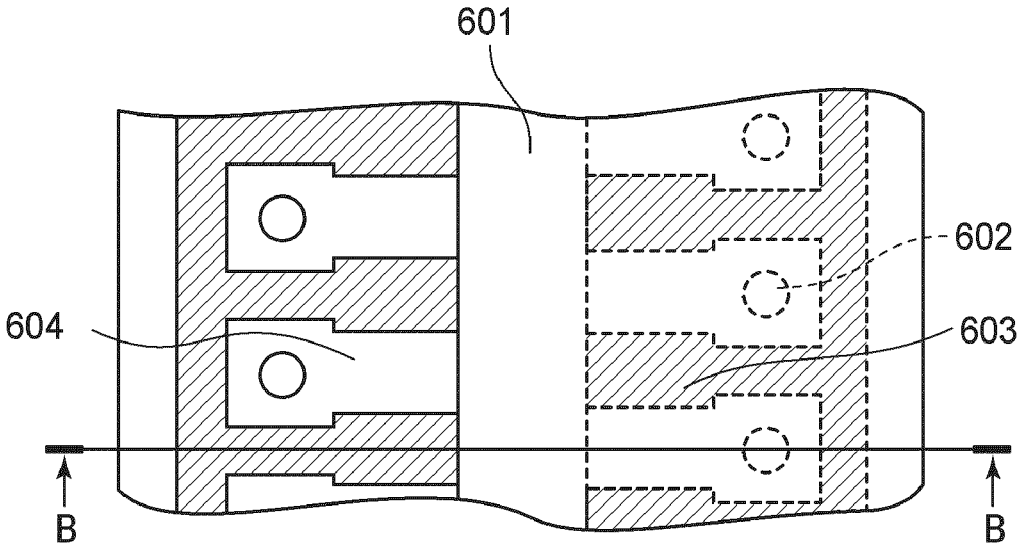
FIG. 6A is a plan view showing a conventional liquid ejection head and FIG. 6B is a sectional view taken along B-B line shown in FIG. 6A.
Figure 6B:
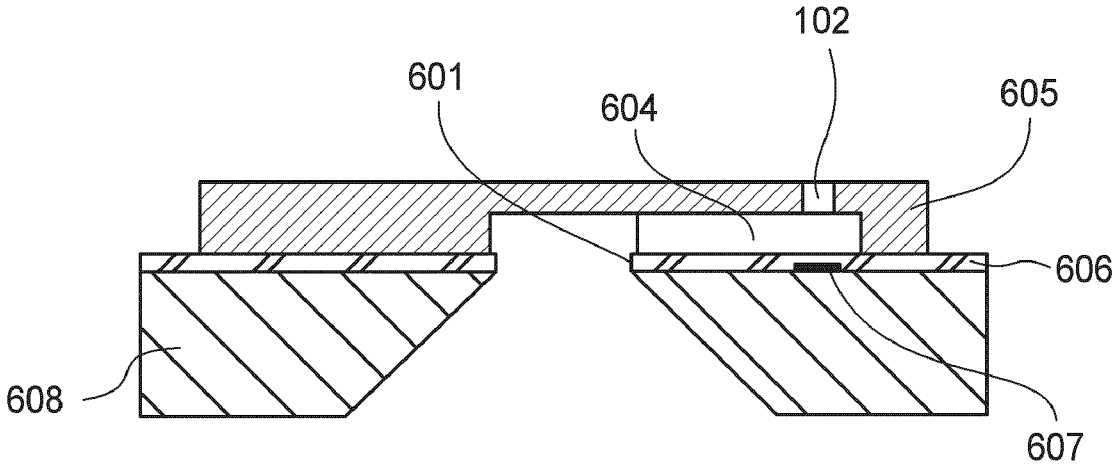

First, a recording apparatus to which a liquid ejection head of this embodiment is applicable will be described. FIG. 5 is a schematic perspective view showing a recording apparatus according to a representative embodiment of the present invention. As shown in FIG. 5, a carriage HC on which an ink jet cartridge IJC is mounted is reciprocated in directions indicated by arrows a and b by a carriage motor 5013. The ink jet cartridge IJC includes a liquid ejection head IJH (hereinafter simply referred to as a "head") and a container IT for storing ink as liquid to be ejected from this head. Recording paper P is conveyed by a platen 5000. Further, the recording apparatus includes a suction unit 5015 for carrying out suction inside a capping member 5022 for covering an ink ejection outlet side of the head. The suction unit 5015 refreshes an ejection characteristic of the head by sucking ink from the head through an inner cap opening 5023 formed in the capping member 5022. Further, the suction unit 5015 includes a cleaning blade 5017 for wiping ink adhered to the ink ejection outlet of the head.

First Embodiment

<Circuit Layout an Device Substrate>

Figure 1A:
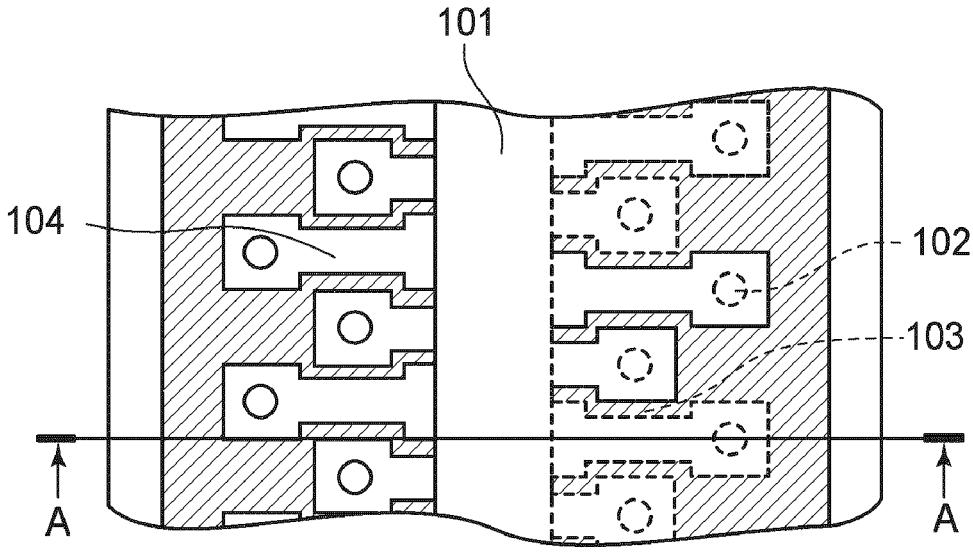
FIG. 1A is a plan view showing a liquid ejection head of First Embodiment and FIG. 1B is a sectional view taken along A-A line shown in FIG. 1A.
Figure 1B:
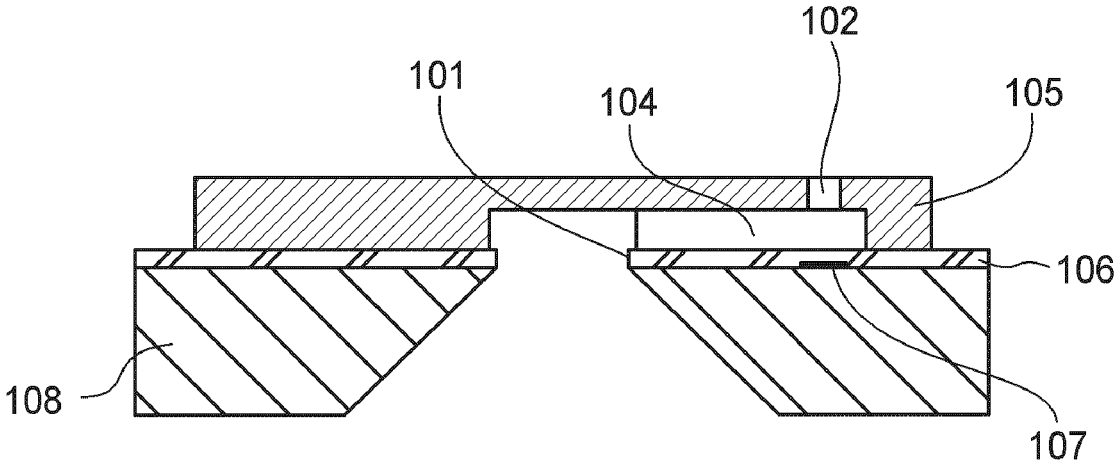

FIG. 1A is a plan view showing a liquid ejection head of this embodiment and FIG. 1B is a sectional view of the liquid ejection head taken along A-A line shown in FIG. 1A.

As shown in FIGS. 1A and 1B, the liquid ejection head of this embodiment includes a plurality of ink ejection outlets 102 for ejecting ink droplets toward a silicon substrate 108 and a plurality of ink flow paths 104 communicating with the ink ejection outlets 102. The liquid ejection head further includes an ink supply port 101 as a supply port for supplying liquid (ink) to the ink flow paths 104 and a plurality of heaters 107 as a heat generating element for generating thermal energy for ejecting the liquid from the inside of the ink flow paths 104.

The heaters 107 are provided correspondingly to the ink ejection outlets 102. The ink ejection outlets 102 and the heaters 107 are disposed along a direction of a long side of an elongated ink supply port 101 with a predetermined (certain) interval (of about 21 μm corresponding to a density of 1200 dpi in this embodiment). Further, with respect to a direction of a short side of the ink supply port 101, the ink ejection outlets 102 and the heaters 107 are disposed in a staggered fashion so that adjacent ink ejection outlets (and heaters) are shifted from each other with respect to the short side direction. When respect to one heater, one ink flow path 104 and one ink ejection outlet 102 are provided. Further, the plurality of ink ejection outlets 102 is formed in the same size. Similarly, the plurality of heaters is formed in the same size.

Oppositely disposed two ink ejection outlets 102 (and heaters 107) with respect to the ink supply port 101 are shifted from each other by about 10.5 μm with respect to the long side direction of the ink supply port 101. That is, the ink ejection outlets 102 and the heaters 107, each of which is provided for one ink supply port 101, are arranged along a longitudinal direction of the ink supply port 101 with a density of 2400 dpi. Further, the ink flow paths 104 have different shapes depending on the difference in distance of the heaters 107 from the ink supply port 101.

The ink is supplied from the ink supply port 101 through the ink flow paths 104 to be filled in the ink flow paths 104 up to the ink ejection outlets 102. In this state, the heaters 107 are supplied with a current to generate heat, so that the ink is heated to cause bubble generation. The ink is ejected from the ink ejection outlets 102 by resultant pressure. At this time, an ejection amount of ink droplets to be ejected is set to about 0.5 ml and a size of each of the heaters 107 is about 15 μm×15 μm.

In the case where the heaters 107 are arranged in a line as in the above-described conventional manner, the distance between ends of adjacent heaters is about 6 μm as described above. As a result, it is very difficult to form a partition wall between the adjacent heaters. However, in this embodiment, the heaters 107 are arranged in the staggered fashion, so that the width the ink flow paths 104 can be increased from 7 μm to 10 μm and the width of the partition walls 103 can be increased from 7 μm to 8 μm.

Figure 2A:
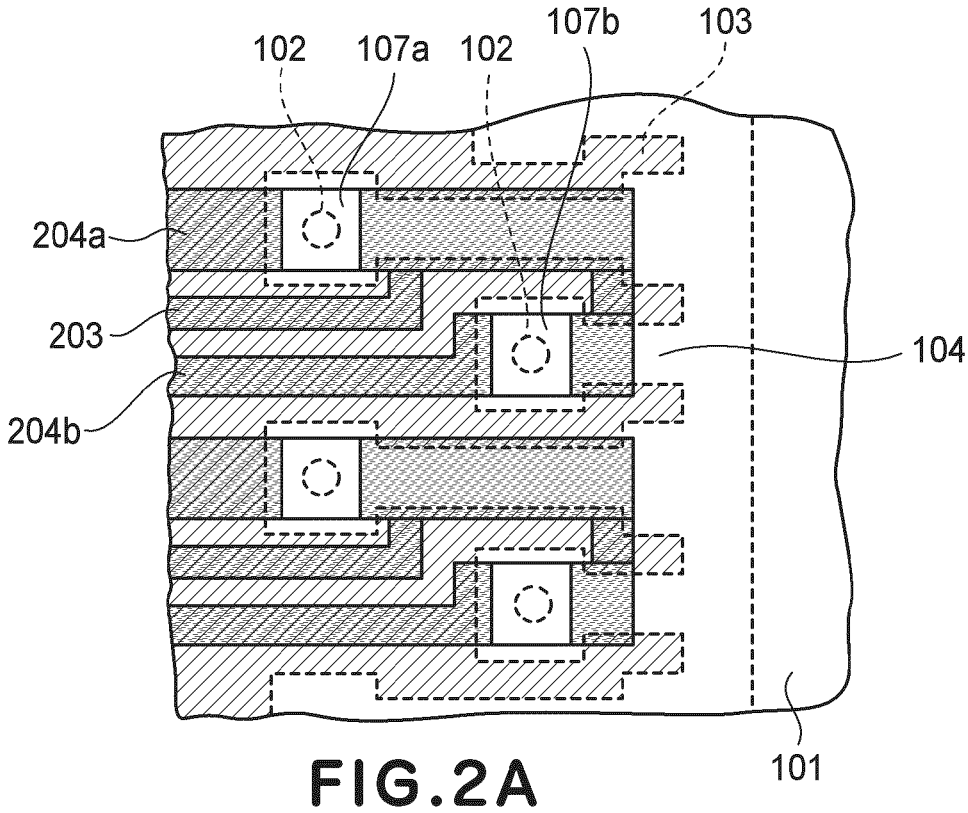
FIGS. 2A and 2B are plan views each showing an example of a wiring pattern for heaters in the liquid ejection head of First Embodiment.

FIG. 2A shows a layout of heater arrangement and wiring lines during arrangement of ink ejection outlets 102. As shown in FIG. 2A, adjacent two heaters 107*a* and 107*b* arranged in the staggered fashion form a pair. To the pair of heaters 107*a* and 107*b*, a common wiring line 203 as a common electrode and individual wiring lines 204 as an individual electrode are electrically connected, respectively. That is, the liquid ejection head includes the common wiring line 203 which is connected to each of the pair of heaters 107*a* and 107*b* and is led out together as a single line and individual wiring lines 204*a* and 204*b* which are connected to the heaters 107*a* and 107*b*, respectively, and are independently led out. Further, the common wiring line 203 and the individual wiring lines 204*a* and 204*b* are formed in the same layer.

Figure 3:
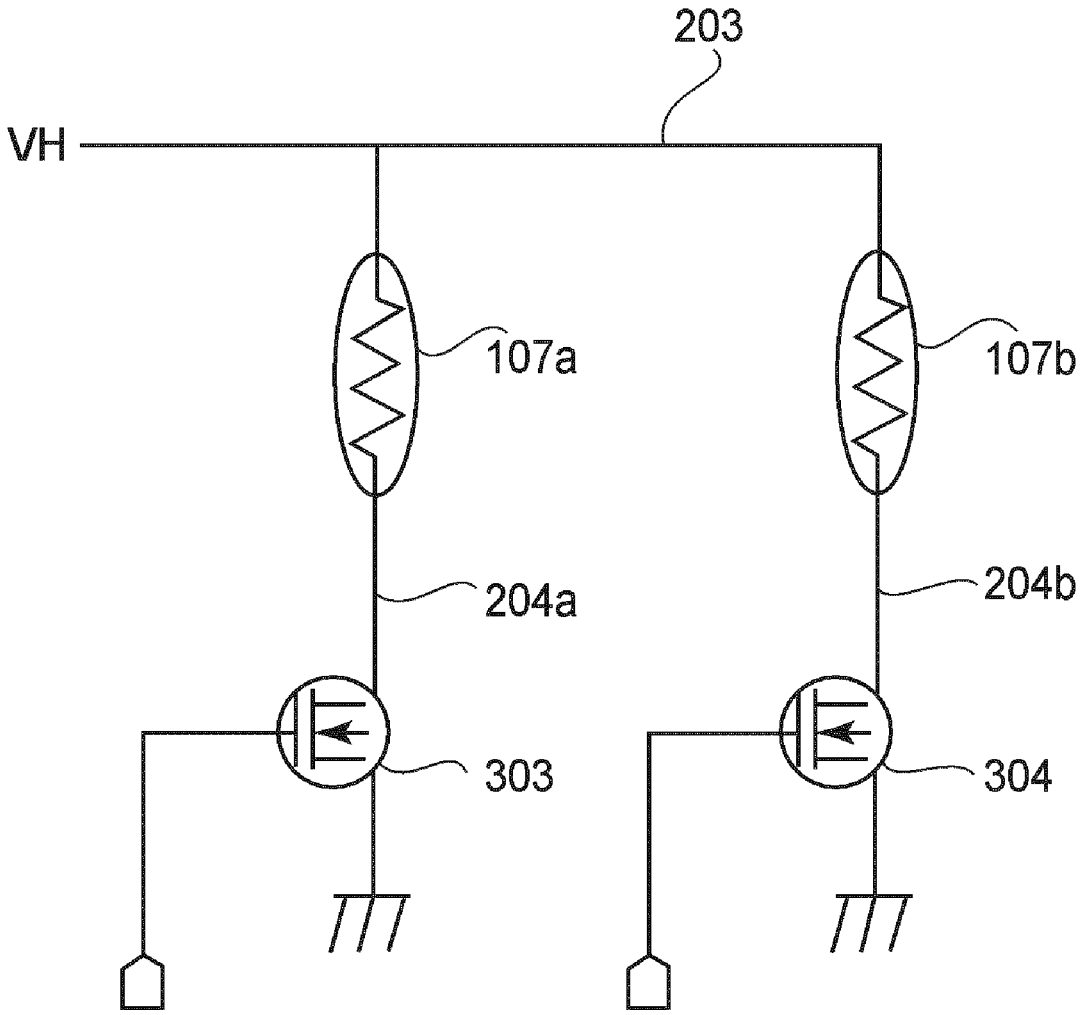
FIG. 3 is a diagram showing a driving circuit of the heaters in the liquid ejection head of First Embodiment.

FIG. 3 is a schematic diagram showing a driving circuit of the pair of heaters 107*a* and 107*b*. The individual wiring lines 204*a* and 204*b* individually connected to the associated one of the heaters 107*a* and 107*b* are connected to drivers 303 and 304 for each segment, respectively. The common wiring line 203 connected to each of the heaters 107*a* and 107*b* is connected to a heater power source VH. By a driver driving signal, the drivers 303 and 304 for each segment are controlled, respectively, to actuate the heaters 107*a* and 107*b*, respectively.

The common wiring line 203 and the individual wiring lines 204*a* and 204*b* are formed of a metal material such as aluminum. These wiring lines shown in FIG. 2 are laid out by such a rule that a width thereof is generally 6 μm or more in view of a density of current passing through the wiring lines and a distance between the wiring lines is 4 μm or more in view of parasitic capacity.

Figure 7:
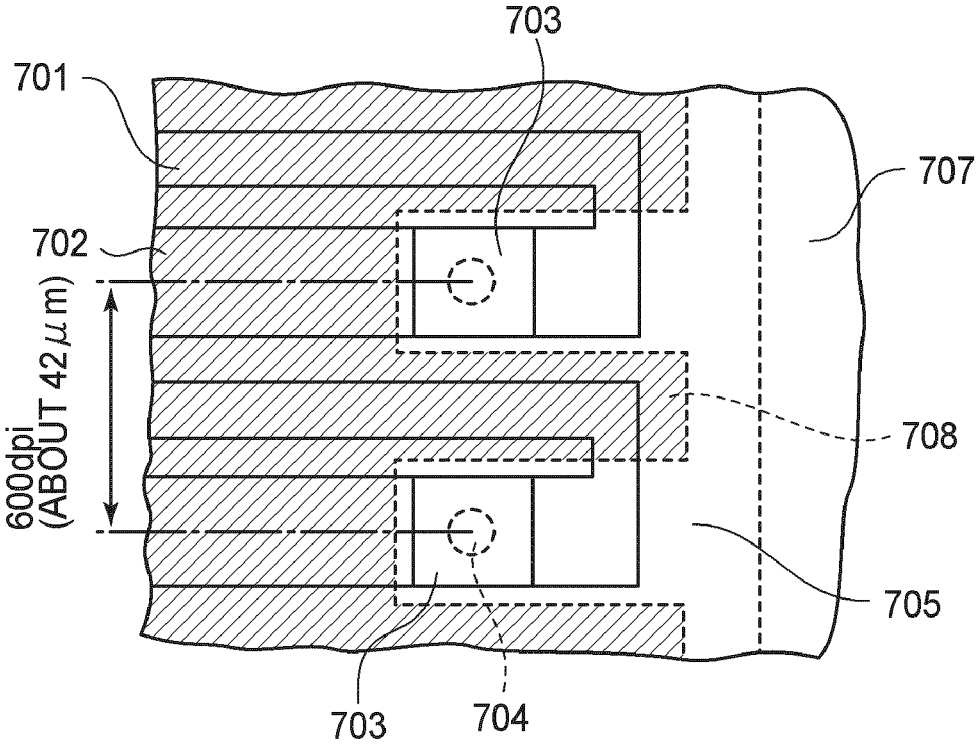
FIG. 7 is a plan view showing a heater wiring pattern of the conventional liquid ejection head.
Figure 8:
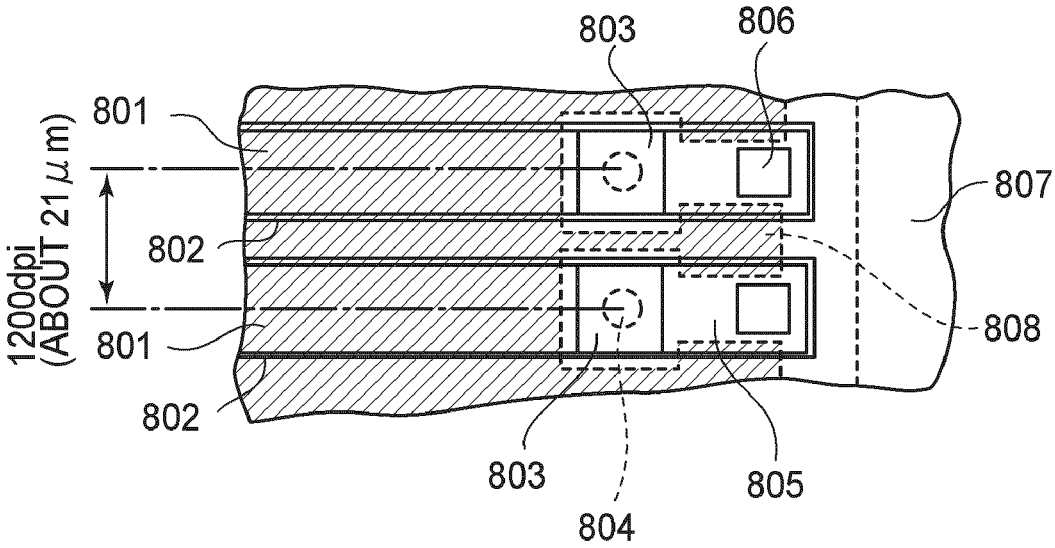
FIG. 8 is a plan view showing a heater wiring pattern increased in arrangement density.

As shown in FIG. 7, in the case of the constitution in which the wiring lines are individually connected to the pair of heaters, as described above, the space of 6 μm between the adjacent heaters can only be ensured at the high heater density (1200 dpi) with values not more than those of the above-described wiring rule. For this reason, in the case of this constitution, a wiring resistance is increased.

However, in this embodiment, the common wiring line 203 which is connected to the adjacent heaters 107*a* and 107*b* at branched two ends, respectively, and is led out as a single line at the remaining end opposite from the branched two ends is provided. By this constitution, the number of wiring line at a periphery of the heaters 107*a* and 107*b* is decreased, so that a latitude of the wiring line layout can be improved. Further, by the above-described constitution, the wiring resistance is reduced, so that so-called energy saving can also be realized. Particularly, in the constitution in which the ink ejection outlets 102 are arranged with the high density as in this embodiment, since the heaters 107 and the wiring lines therefore are disposed with high densities, it is necessary to sufficiently consider the temperature rise of the heaters. However, in this embodiment, the common wiring line 203 is provided, thus being very effective to save energy.

As described above, in this embodiment, the common wiring line 203 which is branched and connected to the pair of heaters 107*a* and 107*b* arranged in the staggered fashion and is led out as the single line is provided. By this constitution, the thickness of the partition wall 103 between the adjacent heaters 107*a* and 107*b* can be sufficiently ensured and it is possible to realize a wiring structure with relative low power loss and temperature rise.

Further, according to the liquid ejection head of this embodiment, it is possible to dispose the ink ejection outlets 102 and the heaters 107 with a further high density. As a result, the heaters 107 can be disposed so as to meet a droplet size from a large droplet to a small droplet with the pitch of 1200 dpi (the density of 2400 dpi per ink supply port 101).

Modified Embodiment of First Embodiment

Figure 2B:
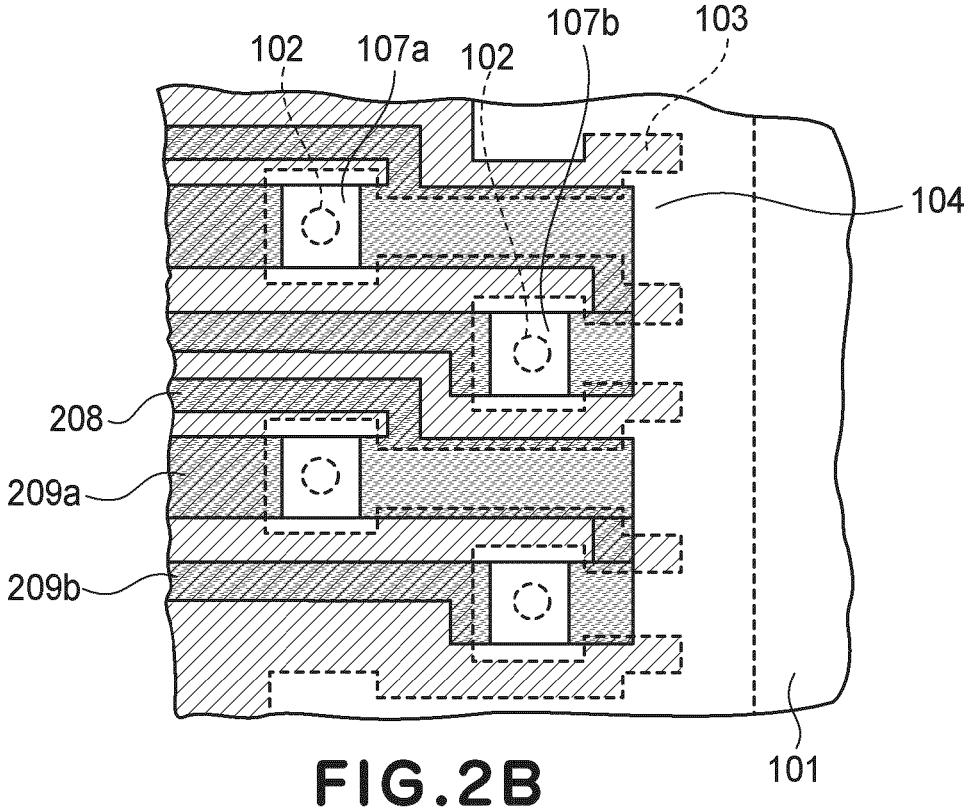

FIG. 2B is a plan view showing a modified embodiment of a heater arrangement and a wiring line layout, wherein the arrangement of the ink ejection outlets is the same as that in First Embodiment. In this embodiment, as shown in FIG. 2B, a common wiring line 208 and individual wiring lines 209*a* and 209*b* connected to the pair of heaters 107*a* and 107*b* are formed in the same layer. Further, the common wiring line 208 is led out from a side opposite from a side where the electrically connected individual wiring lines 209*a* and 209*b* oppose each other. In other words, the common wiring line 208 is led out so as to be adjacent to only one of the electrically connected individual wiring lines 209*a* and 209*b*.

In this embodiment, the common wiring line 208 is disposed close to an electrode pad, thus approaching the power source, so that it is possible to reduce the power loss of the heaters 107 due to the wiring lines for the heaters 107 compared with the case of First Embodiment. However, in the case where the common wiring line 208 is disposed at a position opposite from the position of the electrode pad, compared with the constitution of this embodiment, it is possible to suppress the power loss when the constitution of First Embodiment is employed.

Second Embodiment

Figure 4A:
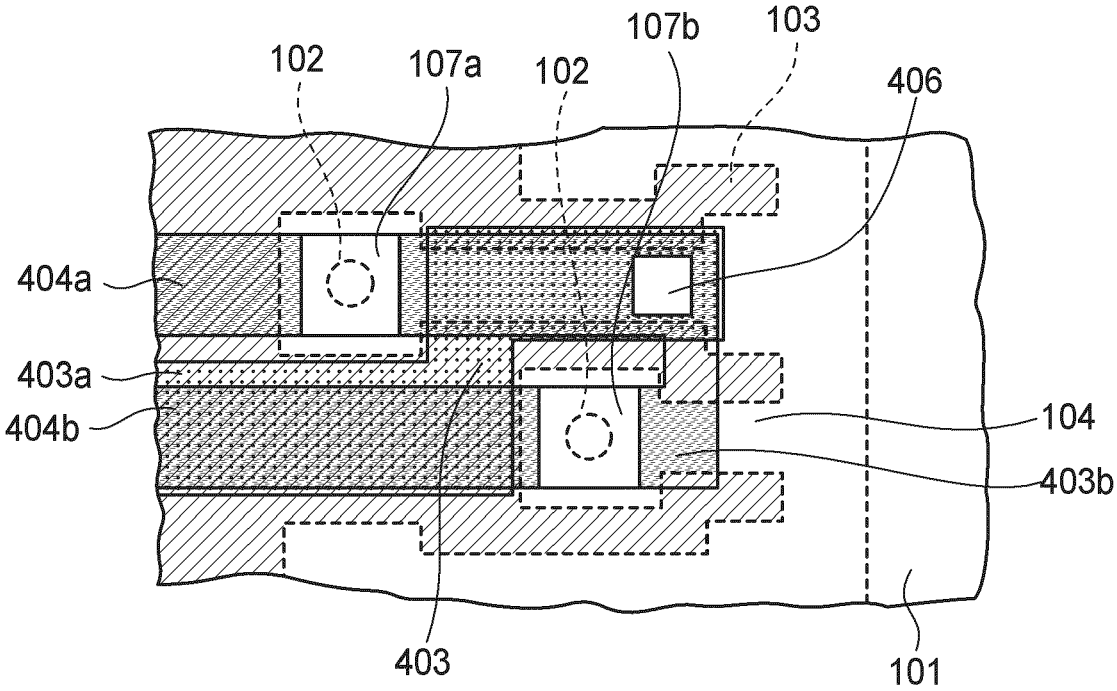
FIGS. 4A and 4B are plan views each showing an example of a heater wiring pattern of a liquid ejection head of Second Embodiment.

FIG. 4A is a plan view showing a heater arrangement and a wiring line layout in this embodiment, wherein the arrangement of the ink ejection outlets is the same as that in the above-described embodiments. As shown in FIG. 4A, a common wiring line 403 and individually wiring lines 404*a* and 404*b* are electrically connected to the pair of heaters 107*a* and 107*b* arranged in the staggered fashion.

Further, in this embodiment, the common wiring line 403 is formed in a two-layer structure consisting of a lower layer of a common wiring line 403*a* and an upper layer of a common wiring line 403*b* which establish electrical conduction through a through hole 406. The upper common wiring line 403*b* and the lower common wiring line 403*a* are formed at a position in which these wiring lines do not overlap with the pair of heaters 107*a* and 107*b*. As a result, it is possible to avoid adverse affect of heat generated by the heaters 107*a* and 107*b* on an Al wiring line constituting the common wiring lines 403*a* and 403*b*.

These wiring lines 403*a*, 403*b*, 404*a* and 404*b* are formed of a metal material such as aluminum.

In this embodiment, a driving circuit of the heaters 107*a* and 107*b* is constituted similarly as in First Embodiment as shown in FIG. 3.

According to this embodiment, the common wiring line 403 is formed in the two-layer structure, so that a total number of the upper common wiring lines 403*b* is decreased. Therefore, compared with the wiring pattern in First Embodiment, a wiring layout further improved in latitude can be realized. Further, a width of each lower common wiring line can also be increased, so that when compared with the case of First Embodiment, the wiring resistance at the periphery of the heaters 107 can be decreased as a whole, with the result that further energy saving can be achieved to suppress temperature rise and increase in electric power of the liquid ejection head.

In addition, by forming the common wiring line 403 in the two layers, the number of wiring lines disposed at the periphery of the heaters 107 can be reduced. As a result, a free space can be ensured at the periphery of the heaters 107 and a size of each heater can be increased, so that it is possible to dispose the heaters with a high density even when the ink ejection amount is 5 p1 and each heater has the size of 20 μm×20 μm.

Further, by the two-layer structure of the common wiring line 403, the number of the wiring lines formed in the same layer as the heaters 107*a* and 107*b* is decreased. For this reason, it is possible to further decrease a distance between the heaters 107*a* and 107*b* arranged in the staggered fashion with respect to a short side direction of the ink supply port 101 (a direction perpendicular to the arrangement direction of the ink ejection outlets 102). As a result, a position of the ink ejection outlet 102 on a side where a longer ink flow path 104 extending from the ink supply port 101 is located can be brought close to the ink supply port 101. It is possible to quickly refill the ink from the ink supply port 101 into the ink ejection outlet 102 on the side where the longer ink flow path 104 is located when compared with the case of First Embodiment.

In this embodiment, the common wiring line 403 is formed in the two-layer structure but may also be formed in a layer structure having three or more layers.

Modified Embodiment of Second Embodiment

Figure 4B:
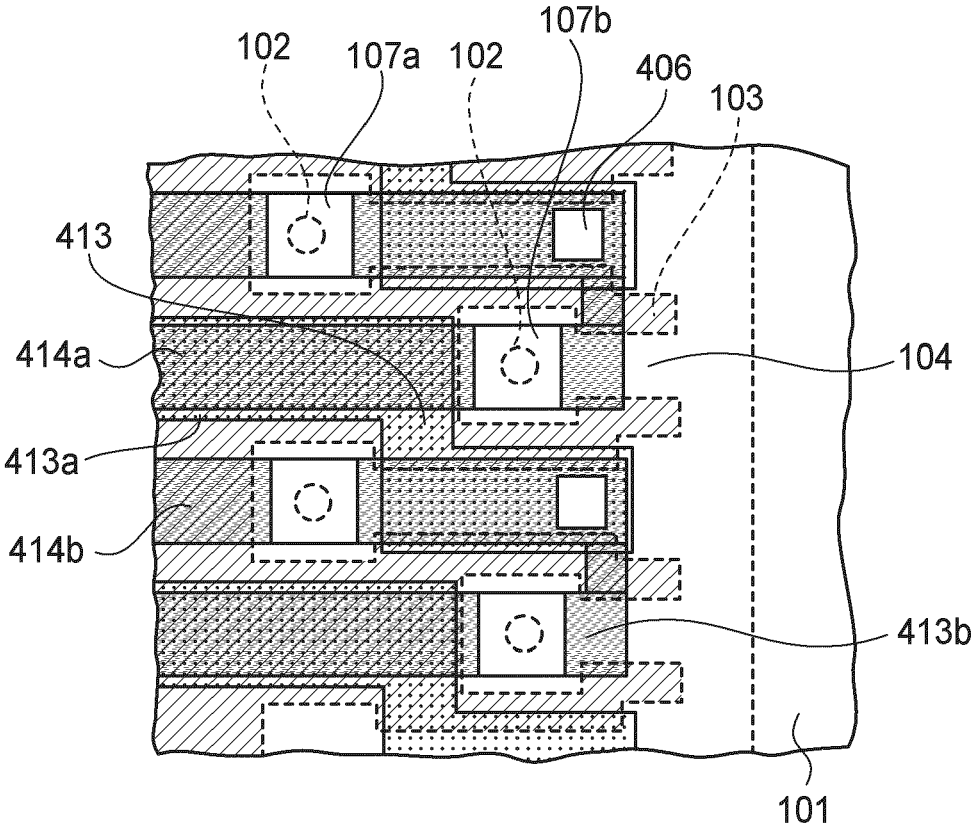

FIG. 4B shows a modified embodiment of Second Embodiment, wherein the heat arrangement and the wiring line layout when the ink ejection outlets are arranged as shown in FIG. 1 are modified. The same constitution as that in Second Embodiment will be omitted from redundant description. In this constitution, a common wiring line (Al wiring line as a lower layer) 413 is led out to the outside of the pair of heaters 107*a* and 107*b*.

This modified embodiment will be described with reference to FIG. 4B. An unshown electrode pad for supplying electric power to the heaters 107 is disposed at an end portion of the ink supply port 101 with respect to the long side direction of the ink supply port 101.

As shown in FIG. 4B, the common wiring line 413 and individual wiring lines 414*a* and 414*b* are electrically connected to the pair of adjacent heaters 107*a* and 107*b* arranged in the staggered fashion. The common wiring line 413 is formed in a two-layer structure consisting of a common wiring line 413*a* as a lower layer and a common wiring line 413*b* as an upper layer. The lower and upper wiring lines 413*a* and 413*b* establish electrical conduction through a through hole 406.

The lower common wiring line 413*a* connected to the pair of adjacent heaters 107*a* and 107*b* is led out to a position where the lower wiring line 413*a* overlaps with an individual wiring line 414*a* for another pair of adjacent heaters 107*a* and 107*b* and is disposed closer to the electrode pad.

According to this modified embodiment, the lower common wiring line 413*a* of the common wiring line 413 is led out toward the electrode pad, so that the common wiring line 413 is disposed closer to the power source. As a result, compared with the constitution shown in FIG. 4A, it is possible to decrease power loss due to the wiring lines. However, in the case where the electrode pad is disposed on a side opposite from the side where the lower common wiring line 413*a* is led out, the constitution shown in FIG. 4A can suppress the power loss rather than the case of the constitution in this modified embodiment.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 221219/2007 filed Aug. 28, 2007, which is hereby incorporated by reference herein.

What is claimed is:

1. A liquid ejection head comprising:

a plurality of ejection outlets for ejecting liquid droplets;

a plurality of flow paths communicating with said ejection outlets;

an ink supply port for supplying liquid to said flow paths; and a plurality of heat generating elements, provided correspondingly to said ejection outlets, for generating thermal energy for ejecting liquid present inside said flow paths, wherein said plurality of heat generating elements is arranged in a staggered fashion with predetermined intervals with respect to a longitudinal direction of said ink supply port, and wherein adjacent staggered heat generating elements of said plurality of heat generating elements are connected to a common wiring line and are connected to individual wiring lines.

2. A head according to claim 1, wherein said plurality of flow paths have different shapes, each of the heat generating elements having an equal distance from said ink supply port having a same shape.

3. A head according to claim 1, wherein each of said plurality of ejection outlets is formed in the same size and each of said plurality of heat generating elements is formed in the same size.

4. A head according to claim 1, wherein said common wiring line and said individual wiring lines are formed in the same layer, and wherein said common wiring line is disposed between said individual wiring lines.

5. A head according to claim 1, wherein said common wiring line and said individual wiring lines are formed in the same layer, and wherein said common wiring line is disposed on a first side of one of said individual wiring lines opposite from a second side which opposes an adjacent one of said individual wiring lines.

6. A head according to claim 1, wherein said common wiring line comprises a plurality of wiring line layers which establish electrical conduction through a through-hole formed in an associated individual wiring line, and wherein the wiring line layers are formed at positions in which the wiring line layers do not overlap with the adjacent staggered heat generating elements.

7. A recording apparatus comprising:

a liquid ejection head according to claim 1 for ejecting liquid onto a recording material to effect recording.

* * * * *